US007014987B2

(12) United States Patent
Takayama et al.

(10) Patent No.: US 7,014,987 B2
(45) Date of Patent: Mar. 21, 2006

(54) MANUFACTURING METHOD OF LIQUID JET HEAD

(75) Inventors: Hidehito Takayama, Kanagawa (JP); Akihiro Mouri, Tokyo (JP); Nobuhito Yamaguchi, Tokyo (JP); Toshihiro Fukasaka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 206 days.

(21) Appl. No.: 10/619,004

(22) Filed: Jul. 15, 2003

(65) Prior Publication Data

US 2004/0017440 A1 Jan. 29, 2004

(30) Foreign Application Priority Data

Jul. 18, 2002 (JP) ..... 2002-209099

(51) Int. Cl.
*B41J 2/045* (2006.01)
*B41J 2/16* (2006.01)

(52) U.S. Cl. ..... 430/320

(58) Field of Classification Search ..... 430/320; 347/47, 68, 70
See application file for complete search history.

(56) References Cited

U.S. PATENT DOCUMENTS

| | | | | |
|---|---|---|---|---|
| 5,229,785 | A * | 7/1993 | Leban | 347/47 |
| 5,478,606 | A | 12/1995 | Ohkuma et al. | |
| 5,980,026 | A * | 11/1999 | Imamura et al. | 347/65 |
| 6,364,468 | B1 * | 4/2002 | Watanabe et al. | 347/68 |
| 2002/0066524 | A1 | 6/2002 | Kagawa et al. | |

FOREIGN PATENT DOCUMENTS

| | | |
|---|---|---|
| JP | 6-115071 | 4/1994 |
| JP | 6-255099 | 9/1994 |
| JP | 6-297704 | 10/1994 |
| JP | 8-142324 | 6/1996 |

* cited by examiner

*Primary Examiner*—John A. McPherson
(74) *Attorney, Agent, or Firm*—Fitzpatrick Cella Harper & Scinto

(57) ABSTRACT

A manufacturing method of a liquid jet head, comprising a step of disposing a liquid flow path pattern containing a soluble resin on a substrate and disposing a coating layer containing a resin forming a wall of the liquid flow path so as to coat the liquid flow path pattern, a step of disposing a liquid discharge energy generation element for generating energy for use in discharging a liquid in a place disposed opposite to the liquid flow path pattern, a step of separating and removing the substrate, and a step of removing the liquid flow path pattern to form the liquid flow path.

8 Claims, 7 Drawing Sheets

MANUFACTURING METHOD OF LIQUID JET HEAD

BACKGROUND OF THE INVENTION

1. Field of the Invention

The present invention relates to a manufacturing method of a liquid jet head for discharging/flying droplets to deposit the droplets to a recording medium.

2. Description of the Related Art

A liquid jet head for use in a liquid jet recording system (ink jet print system) generally includes a discharge port (orifice) for discharging liquids such as ink, a liquid flow path connected to the discharge port, and a liquid discharge energy generation element disposed in the liquid flow path. The head has characteristics that generation of noises at a recording time is small to an ignorable degree, high-speed recording and recording with respect to various recording mediums are possible, the recording liquid is fixed even to a so-called plain paper without requiring any special treatment, and a high-precision image is inexpensively obtained. Because of these advantages, use of such a head has rapidly spread, not only in a printer which is a peripheral apparatus of a computer but also in a printing system such as a copying machine, facsimile, and word processor over the past several years. For liquid discharge methods of a liquid jet apparatus for broad and general use, there have been a method of using an electrothermal conversion device (heater), and a method of using a piezoelectric element (piezo element). In either method, it is possible to control the discharge of the droplets by an electric signal.

As a method of preparing this liquid jet head, for example, a method has been known in which, after forming a fine groove for forming a liquid flow path in a plate of glass or metal by a processing method such as cutting and etching, a substrate for the liquid jet head, including a liquid discharge energy generation element, is bonded to the plate in which the groove is formed to form a liquid flow path.

For example, as described in Japanese Patent Application Laid-Open No. 6-255099, a method is known in which a vibration plate including a diaphragm portion is laminated on the piezoelectric element as the liquid discharge energy generation element. A liquid chamber to be pressurized by the piezoelectric element through the diaphragm portion and a liquid flow path forming member for forming a liquid flow path to supply the liquid to the liquid chamber are laminated on the vibration plate. Furthermore, a nozzle forming member in which a nozzle hole is formed is laminated on the liquid flow path forming member.

Moreover, for example, Japanese Patent Application Laid-Open No. 6-115071 discloses a method in which a plurality of piezoelectric elements which are liquid discharge energy generation elements are bonded/arranged in a row onto the substrate. Furthermore, a liquid common channel member positioned around the piezoelectric elements to form a liquid common channel is bonded. The vibration plate is bonded onto the liquid common channel member, a partition wall member is bonded onto the vibration plate, a nozzle plate is bonded onto the partition wall member, and a liquid chamber (pressurized liquid chamber) to be pressurized through the vibration plate by the piezoelectric element is formed by the vibration plate, partition wall member, and nozzle plate.

Furthermore, for example, Japanese Patent Application Laid-Open No. 8-142324 discloses a method in which a plurality of piezoelectric elements are bonded in a plurality of rows onto the substrate, and a frame member positioned around the piezoelectric elements is also bonded so that an actuator unit is constituted. A liquid chamber partition wall member for forming a pressurized liquid chamber to be pressurized by the piezoelectric element through a diaphragm portion and a common liquid chamber to supply the liquid to this liquid chamber is laminated on a vibration plate which includes the diaphragm portion. Furthermore, a nozzle plate in which the nozzle is formed is laminated on the liquid chamber partition wall member to form a liquid chamber unit. The liquid chamber unit is bonded to the actuator unit.

Additionally, for example, as described in Japanese Patent Application Laid-Open No. 6-297704, a photosensitive resin is used as the liquid chamber partition wall member to bond a plurality of photosensitive resin layers so that the liquid chamber is formed. Alternatively, another resin molding is employed, or a multiplicity of layers of metal plates are bonded to one another so as to form a fine liquid chamber.

However, in the above-described conventional manufacturing method of the liquid jet head, when the groove forming the liquid flow path is formed by a cutting step, it is difficult to smoothen an inner wall surface of the groove. Moreover, the plate easily cracks or breaks, and the yield is not very good. On the other hand, when the groove is formed by etching, it is difficult to perform the etching uniformly with respect to all the grooves for forming the liquid flow paths. There are also disadvantages that the process is complicated and the manufacturing cost is increased. Accordingly, it is difficult to prepare the liquid jet heads uniformly including uniform liquid flow paths even by any processing means, and the obtained liquid jet heads tend to have unevenness in print characteristics. Furthermore, when bonding the plate, in which the groove for forming the liquid flow path is formed, to the substrate for the liquid jet head, in which the liquid discharge energy generation element is disposed, it has been difficult to position the groove and liquid discharge energy generation element with good precision. Therefore, the above-described conventional manufacturing method has not been suitable for mass production of high-quality liquid jet heads.

As described above, in the related art, various steps are carried out in the manufacturing method of the liquid jet head. However, in any step, it has been a problem to form a high-precision liquid flow path. Moreover, even if the high-precision liquid flow path can be formed, it has been a problem to exactly position the liquid flow path with respect to the liquid discharge energy generation element.

SUMMARY OF THE INVENTION

One of objects of the present invention is to provide a manufacturing method of a liquid jet head in which a liquid flow path is formed with a high precision, the liquid flow path and a liquid discharge energy generation element can be positioned exactly, and productivity of the liquid jet head of high grade can be enhanced.

According to the present invention, there is provided a manufacturing method of a liquid jet head, comprising: a step of disposing a liquid flow path pattern containing a soluble resin on a substrate and disposing a coating layer containing a resin forming a wall of the liquid flow path so as to coat the liquid flow path pattern; a step of disposing a liquid discharge energy generation element for generating energy for use in discharging a liquid in a place disposed opposite to the liquid flow path pattern; a step of separating and removing the substrate; and a step of removing the liquid flow path pattern to form the liquid flow path.

According to the present invention, the liquid discharge energy generation element is disposed before removing the substrate, which is a member having a relatively high strength. Thereafter, the substrate is removed. Therefore, the liquid jet head having high reliability can be manufactured. Additionally, after the substrate is removed, the liquid flow path pattern is removed to form the liquid flow path. Therefore, the forming of the highly precise liquid flow path by the removal of the liquid flow path pattern is carried out relatively later in a flow of the manufacturing steps. This is preferable because it reduces the possibility of invasion of foreign particles into the liquid flow path and further enhances the reliability of the head.

In the present invention, a photosensitive resin which contributes to the forming of the liquid flow path is formed on the substrate, and further a resin for coating is formed on the photosensitive resin. Thereafter, when the photosensitive resin of a liquid flow path portion is dissolved/removed to form the liquid flow path, the liquid flow path with a higher precision can be formed.

Moreover, when a convex portion extending onto a liquid pressurizing chamber in a longitudinal direction is formed with a high precision, and a liquid flow path constituting member is formed by a resin having optical transmission, the positioning of the liquid discharge energy generation element and liquid pressurizing chamber can correctly and easily be performed.

Accordingly, it is possible to prepare a liquid jet head of a high grade with a high yield, and productivity in the manufacturing of the liquid jet head can remarkably be enhanced.

DESCRIPTION OF THE PREFERRED EMBODIMENTS

Embodiments of the present invention will be described hereinafter with reference to the drawings.

Figure 1:
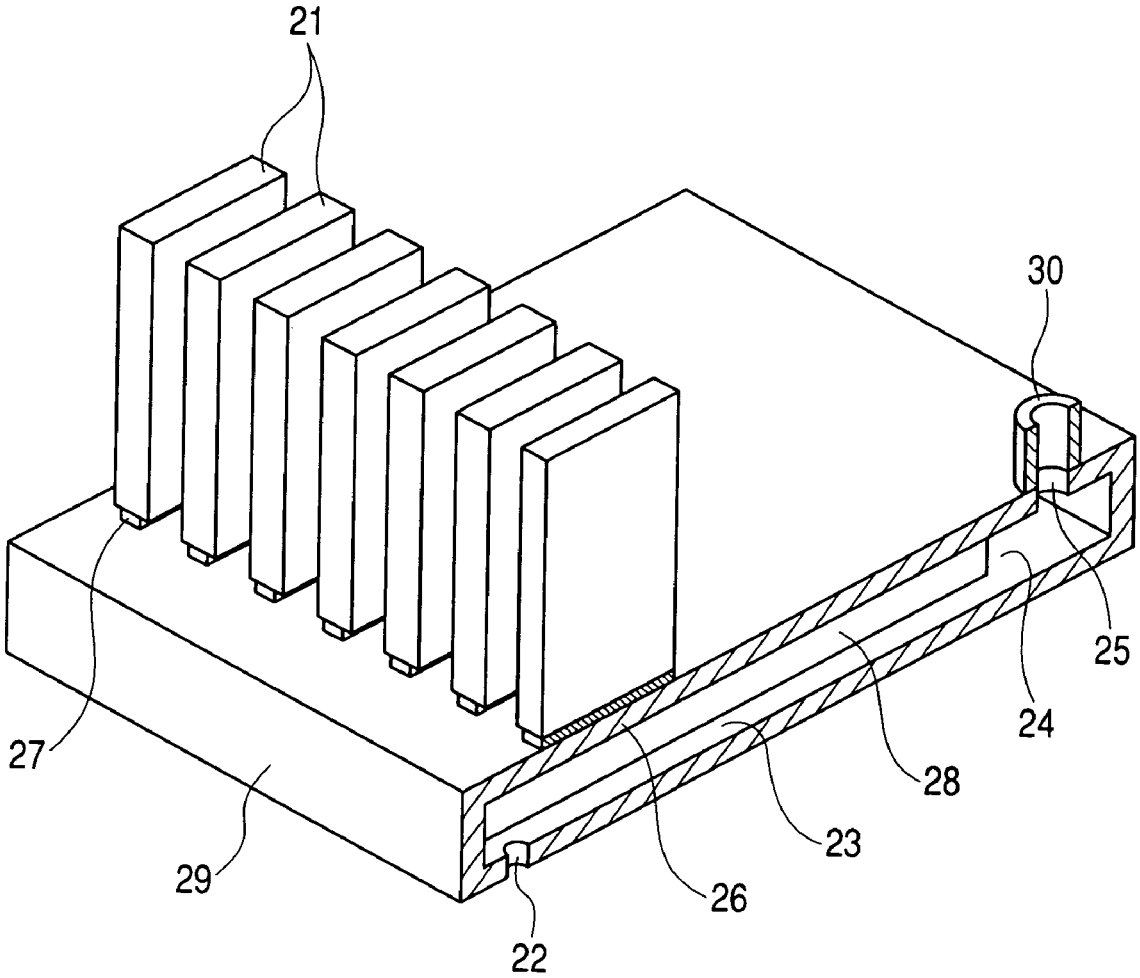
FIG. 1 is a perspective view showing a liquid jet head prepared by a manufacturing method of the liquid jet head according to the present invention in a partially broken state seen from a side of a piezoelectric element which is a liquid discharge energy generation element.

FIG. 1 is a perspective view showing a liquid jet head prepared by a manufacturing method of the liquid jet head according to the present invention in a partially broken state seen from a side of a piezoelectric element which is a liquid discharge energy generation element.

As shown in FIG. 1, the liquid jet head prepared by the manufacturing method of the liquid jet head according to the present invention includes: piezoelectric elements 21 which are liquid discharge energy generation elements to generate pressure for discharging a liquid; liquid discharge ports 22 for discharging the liquid; liquid pressurizing chambers 23 for containing and pressurizing the liquid to be discharged; a liquid supply path 24 connected to each liquid pressurizing chamber 23; a liquid supply port 25, connected to the liquid supply path 24, for supplying the liquid; a vibration plate 26 for pressurizing the liquid pressurizing chamber 23; and bond portions 27 which are disposed to bond the vibration plate 26 to the piezoelectric elements 21 and which extend in a longitudinal direction of the liquid pressurizing chamber 23 and which include convex portions, so-called island structures. A plurality of liquid pressurizing chambers 23 are individually separated by partition walls 28 and juxtaposed and formed. Accordingly, a plurality of liquid discharge ports 22 are similarly juxtaposed and formed. A liquid supply member 30 is bonded to the liquid supply port 25 by an adhesive. When the liquid supply member 30 is connected to a liquid tank (not shown), the liquid is supplied. In FIG. 1, reference numeral 29 is a liquid flow path constituting member which constitutes a liquid flow path including the liquid pressurizing chambers 23 and liquid supply paths 24, and the vibration plate 26.

In the present embodiment, in the piezoelectric element 21 which is the liquid discharge energy generation element, a piezoelectric element, including a structure in which lead zirconate titanate (PZT) as a piezoelectric material and an electrode are laminated, is used. Moreover, each piezoelectric element 21 is fixed to a base plate (not shown in FIG. 1), and a plurality of piezoelectric elements 21 are juxtaposed and arranged opposite to the liquid pressurizing chambers 23. In each piezoelectric element 21, an individual electrode for driving (not shown) and a common electrode (not shown) are formed. The individual electrode and common electrode are connected to a signal line and common line, respectively, and a driving signal is sent from a driving circuit (not shown).

Next, a first embodiment of the manufacturing method of the liquid jet head according to the present invention will be described with reference to FIGS. 2A to 2M. FIGS. 2A to 2M show schematic step diagrams showing major steps of the first embodiment of the manufacturing method of the liquid jet head according to the present invention in cross-sectional views. In the following discussion, the reference numerals of the members shown in FIG. 1 will be shown in parentheses.

Figure 2A:
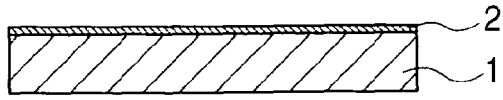
FIGS. 2A, 2B, 2C, 2D, 2E, 2F, 2G, 2H, 2I, 2J, 2K, 2L and 2M show schematic step diagrams showing major steps of a first embodiment of the manufacturing method of the liquid jet head according to the present invention in cross-sectional views.

In FIG. 2A, a 5 mm thick substrate of glass having heat resistance is used as a substrate 1 and a separating layer 2 is formed on the substrate 1. For the separating layer 2, PET is coated with soluble polymethyl isopropenyl ketone (ODUR-1010 manufactured by Tokyo Ohka Kogyo Co., Ltd.) and dried to form a dry film having a film thickness of 2 $\mu$m. The film was laminated and accordingly transferred onto the substrate 1. It is to be noted that ODUR-1010 has low viscosity and cannot be formed into a thick film, and was therefore condensed and used. Next, the substrate was pre-baked at 120° C. for 20 minutes.

Figure 2B:
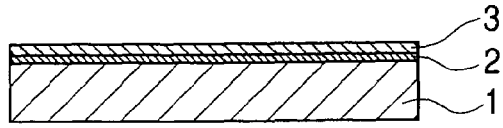

Next, as shown in FIG. 2B, in order to form a part of the liquid flow path constituting member (29) constituting the partition walls of the liquid flow paths (corresponding to the members shown by reference numerals 23, 24 in FIG. 1), a first coat resin layer 3 having a film thickness of 5 $\mu$m is formed on the separating layer 2 by spin coating or roll coating. As the first coat resin layer 3, a resin composition containing 100 parts of an epoxy resin (o-cresol novolak type epoxy resin), one part of a photo cation polymerization initiator (4,4-di-t-butylphenyl iodonium hexafluoroantimonate), and 10 parts of a silane coupling agent (A-187 manufactured by Nihon Yunika Co.) is dissolved in a methyl isobutyl ketone/xylene mixture liquid at a concentration of 50 wt %. The first coat resin layer 3 having a film thickness of 5 μm and having photosensitivity was formed on the separating layer 2 by spin coating and subsequently exposed to be cured.

Figure 2C:
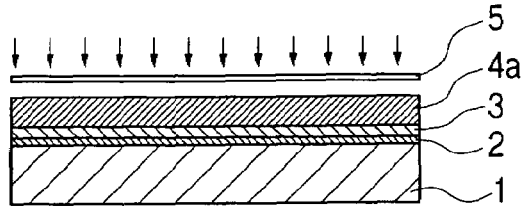

Next, as shown in FIG. 2C, a soluble resin layer 4*a* having a film thickness of 10 μm is formed on the first coat resin layer 3 in order to form the liquid pressurizing chamber (23) and liquid supply path (24). For the resin layer 4*a*, PET is coated with soluble polymethyl isopropenyl ketone (ODUR-1010 manufactured by Tokyo Ohka Kogyo Co., Ltd.) and dried to form a dry film having a film thickness of 10 μm. The film was laminated and accordingly transferred onto the first coat resin layer 3. It is to be noted that ODUR-1010 has low viscosity and cannot be formed into a thick film, and was therefore condensed and used. Next, the layer was pre-baked at 120° C. for 20 minutes.

Figure 2D:
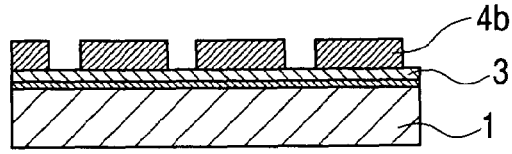

Thereafter, a mask 5 is used to expose the pattern of the liquid flow path by a mask aligner PLA520 (cold mirror CM290) manufactured by Canon Inc. The exposure was carried out for 1.5 minute, methyl isobutyl ketone/xylene=2/1 was used for development, and xylene was used forrinsing. Accordingly, as shown in FIG. 2D, a pattern 4*b* is formed by a soluble resin, and this pattern 4*b* is formed in order to secure the liquid pressurizing chambers (23) and liquid supply paths (24).

Figure 2E:
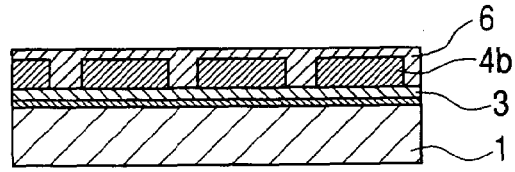

Next, as shown in FIG. 2E, in order to form a part of the vibration plate (26), partition wall (28) of the liquid flow path, or liquid flow path constituting member (29), a second coat resin layer 6 having a film thickness of 5 μm is formed on the pattern 4*b* by spin coating or roll coating. As the second coat resin layer 6, the resin composition containing 100 parts of the epoxy resin (o-cresol novolak type epoxy resin), one part of the photo cation polymerization initiator (4,4-di-t-butylphenyl iodonium hexafluoroantimonate), and 10 parts of the silane coupling agent (A-187 manufactured by Nihon Yunika Co.) is dissolved in the methyl isobutyl ketone/xylene mixture liquid at the concentration of 50 wt %. The second coat resin layer 6 having a film thickness of 5 μm and having photosensitivity was formed on the pattern 4*b* by spin coating and subsequently exposed to be cured.

Figure 2F:
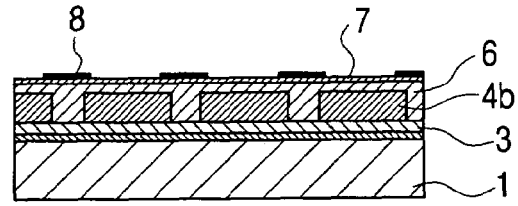
Figure 2G:
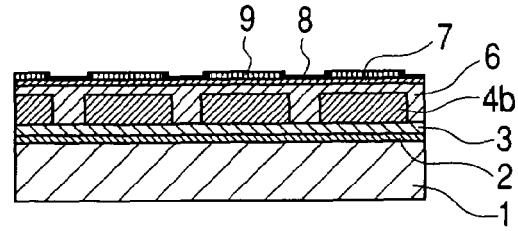
Figure 2H:
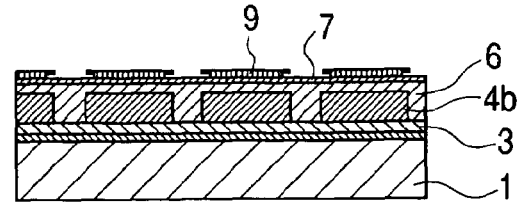

Next, as shown in FIGS. 2F to 2H, the bond portions (27) for bonding the piezoelectric elements 21 are formed on the second coat resin layer 6. For this, first, as shown in FIG. 2F, an electrode layer 7 is formed by electroless plating. Subsequently, a non-conductive photo resist layer having a film thickness of 5 μm is applied, and a pattern 8 is formed so as to agree with a shape of a bottom of the bond portions (27). Next, this is immersed in an electrolysis liquid for electroforming containing aqueous liquid nickel ion containing 30 wt % of nickel sulfamate, 0.5 wt % of nickel chloride, 4 wt % of boric acid, 1 wt % of a brightener, and 0.5 wt % of a pit preventive agent. The electrode layer 7 is used as a negative pole, and the electroforming is carried out at a current density of about 2 mA/cm$^2$. As a result, as shown in FIG. 2G, nickel in the electrolysis liquid is selectively deposited on a portion of the pattern 8 in which a photo resist layer is not formed, and the thickness of this portion increases. When the height of the pattern 8 of the photo resist layer was projected, and the pattern was developed to obtain a thickness of 18 μm, an overhang having a length of 10 μm was generated even in the surface direction of the pattern 8 of the photo resist layer by an edge effect, and electric conduction was stopped. Next, as shown in FIG. 2H, the pattern 8 of the photo resist layer was washed away to form bond portions 9 including island structures whose sections were of a rivet type.

Figure 2I:
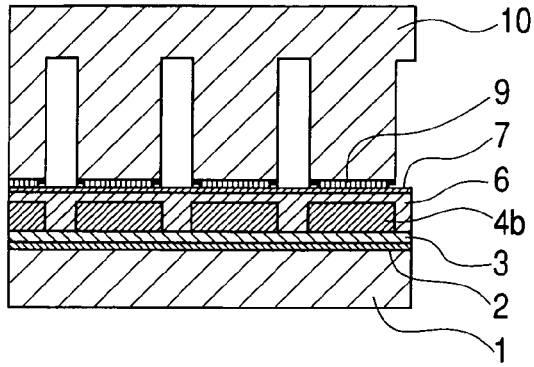

Next, as shown in FIG. 2I, an epoxy-based adhesive is used to bond a piezoelectric element 10 to the bond portions 9 including the island structures. During the bonding of the piezoelectric element 10, since the substrate 1 and/or resin layers other than the bond portions 9 has the property of optical transmission, an alignment mark (not shown) formed on the piezoelectric element 10 is observed from the substrate 1 side with a stereomicroscope, and the piezoelectric element 10 can be bonded. As the stereomicroscope, the SZH-10 (trade name) manufactured by Nikon Corp. was used. In this case, the position of the piezoelectric element 10 can accurately be determined with respect to the bond portions 9, and positional accuracy can be enhanced. After bonding the device with the epoxy-based adhesive, the device was pre-baked at 120° C. for 20 minutes.

Figure 2J:
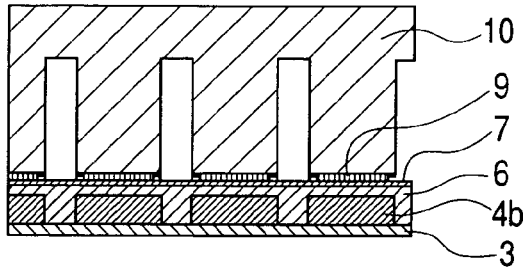

Next, as shown in FIG. 2J, an ultrasonic wave is applied into methyl isobutyl ketone while immersing the material, the separating layer 2 between the substrate 1 and first coat resin layer 3 is eluted, and the substrate 1 is separated.

Figure 2K:
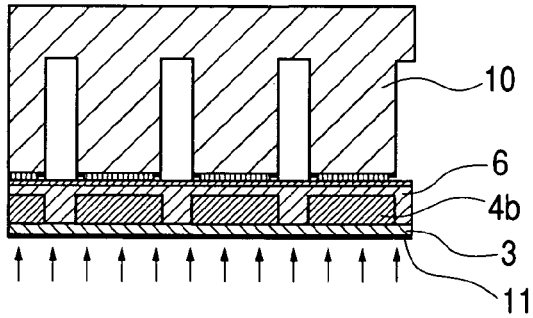
Figure 2L:
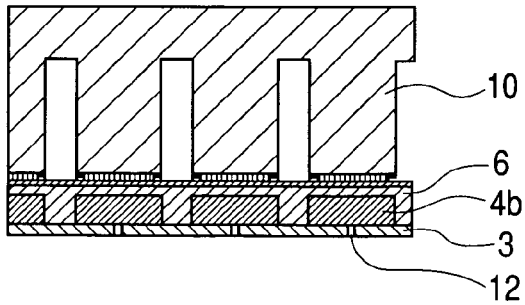

Next, as shown in FIGS. 2K and 2L, the liquid discharge ports (22) are formed. First, as shown in FIG. 2K, the surface of the first coat resin layer 3 is coated with a silicon-containing positive resist 11 (FH-SP (trade name) manufactured by Fuji Hunt Co., Ltd.), and the liquid discharge ports (22) are patterned. Subsequently, an excimer laser is used to irradiate the pattern through a mask. Accordingly, liquid discharge ports 12 are formed in the first coat resin layer 3 by laser abrasion. It is to be noted that the laser abrasion was ended at an arbitrary point in the soluble resin layer 4*b*.

Figure 2M:
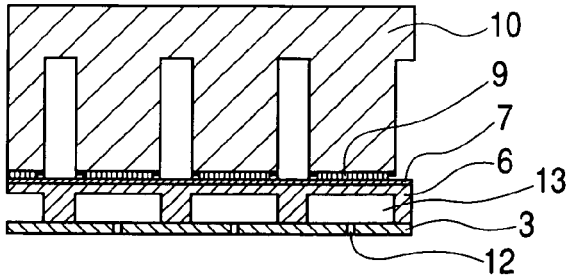

Next, as shown in FIG. 2M, the ultrasonic wave is applied into methyl isobutyl ketone while immersing the layers, the soluble pattern resin layer 4*b* is eluted, and liquid flow paths 13 (liquid pressurizing chamber (23) or liquid supply path (24)) are formed.

Once the liquid flow paths 13 constituting the liquid pressurizing chamber (23) and liquid supply path (24) and the piezoelectric element 10 (21) have been formed in this manner, the liquid supply member (30) for supplying the liquid is bonded and the signal line and common line for driving the piezoelectric element 10 (21) which is a liquid discharge pressure generation device are electrically bonded so that the liquid jet head is completed.

The liquid jet head prepared in this manner was mounted on a liquid jet apparatus, and ink containing pure water/diethylene glycol/isopropyl alcohol/lithium acetate/black dyestuff food black 2=79.4/15/3/0.1/2.5 was used to perform printing/recording. Then, stable printing was possible, and an obtained printed matter was of a high grade.

Next, a second embodiment of the manufacturing method of the liquid jet head according to the present invention will be described with reference to FIGS. 3A to 3M. FIGS. 3A to 3M show schematic step diagrams showing the major steps of the present embodiment in cross-sectional views.

The present embodiment is different from the first embodiment only in that oxygen plasma etching is used in the forming step of the liquid discharge ports (22); the other steps are similar to those in the first embodiment, and the same constitutions and members as those of the first embodiment will be denoted with the same reference numerals and description thereof will be omitted.

Figure 3A:
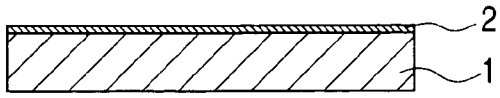
FIGS. 3A, 3B, 3C, 3D, 3E, 3F, 3G, 3H, 3I, 3J, 3K, 3L and 3M show schematic step diagrams showing the major steps of a second embodiment of the manufacturing method of the liquid jet head according to the present invention in cross-sectional views.
Figure 3B:
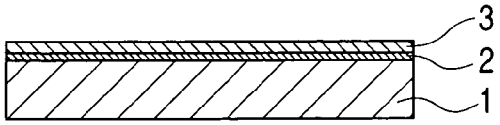
Figure 3C:
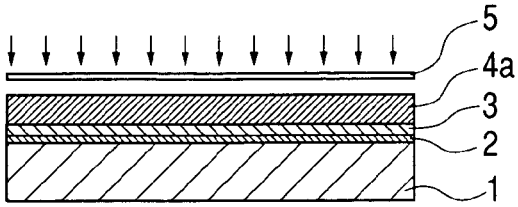
Figure 3D:
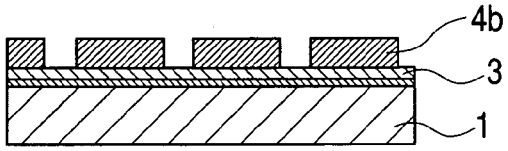
Figure 3E:
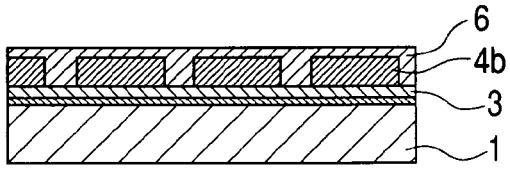
Figure 3F:
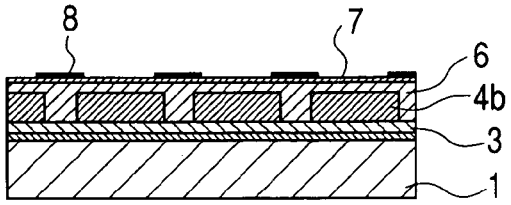
Figure 3G:
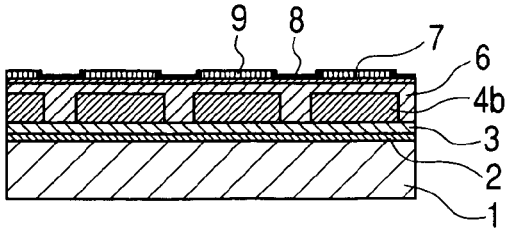
Figure 3H:
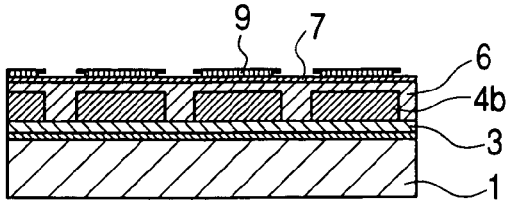
Figure 3I:
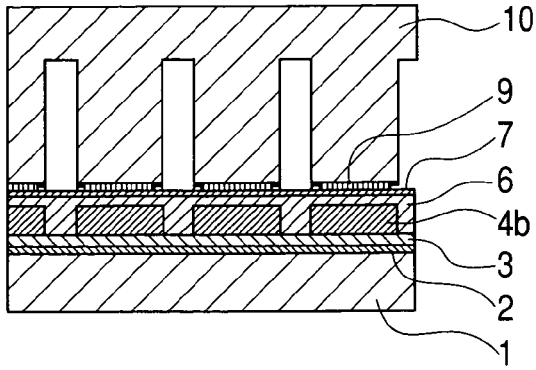
Figure 3J:
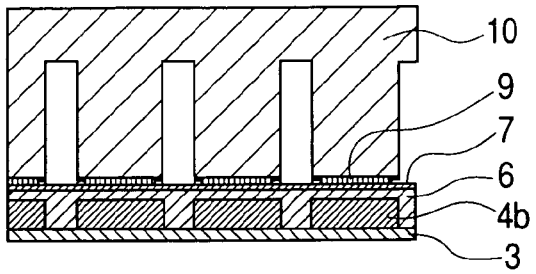
Figure 3K:
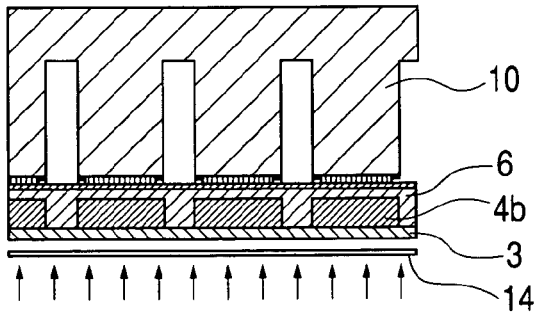
Figure 3L:
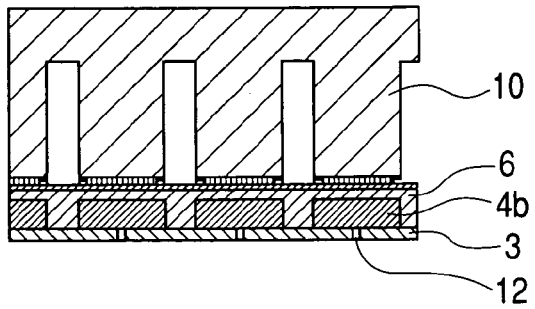
Figure 3M:
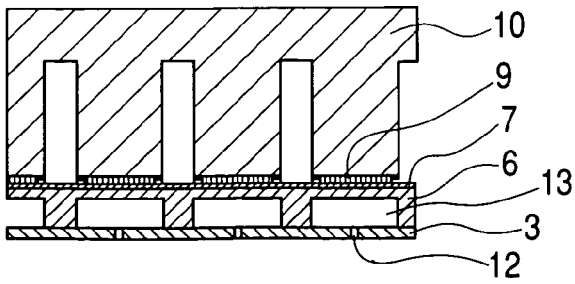

That is, the steps of FIGS. 3A to 3J in the present embodiment (the steps until the piezoelectric element 10 is bonded) are similar to those of FIGS. 2A to 2J of the first embodiment, and the description thereof is omitted. In the present embodiment, as shown in FIGS. 3K and 3L, oxygen plasma etching is used to form the liquid discharge ports (22). A resist 14 is allowed to function as an oxygen-resistant plasma film, and the liquid discharge ports 12 (22) are etched in the first coat resin layer 3 by oxygen plasma etching. This etching was ended at an arbitrary point in the soluble resin layer 4*b*. Subsequently, in the same manner as in the first embodiment, as shown in FIG. 3M, the soluble resin layer 4*b* was eluted to form the liquid flow path 13 (liquid pressurizing chamber (23) or liquid supply path (24)).

Even in the liquid jet head formed in this manner, in the same manner as in the liquid jet head of the first embodiment, stable printing was possible, and the obtained printed matter was of a high grade.

Next, a third embodiment of the manufacturing method of the liquid jet head according to the present invention will be described with reference to FIGS. 4A to 4K. FIGS. 4A to 4K show schematic step diagrams showing the major steps of the present embodiment in cross-sectional views. It is to be noted that also in the present embodiment, the same constitutions and members as those of the above-described embodiment will be denoted with the same reference numerals.

Figure 4A:
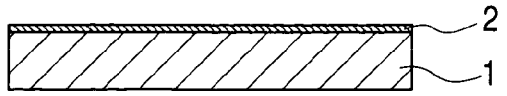
FIGS. 4A, 4B, 4C, 4D, 4E, 4F, 4G, 4H, 4I, 4J and 4K show schematic step diagrams showing the major steps of a third embodiment of the manufacturing method of the liquid jet head according to the present invention in cross-sectional views.

In FIG. 4A, a 5 mm thick substrate of glass having heat resistance is used as the substrate 1 and the separating layer 2 is formed on the substrate 1. For the separating layer 2, PET is coated with soluble polymethyl isopropenyl ketone (ODUR-1010 manufactured by Tokyo Ohka Kogyo Co., Ltd.) and dried to form a dry film having a film thickness of 2 μm. The film was laminated and accordingly transferred onto the substrate 1. It is to be noted that ODUR-1010 has low viscosity and cannot be formed into a thick film, and was therefore condensed and used. Next, the substrate was pre-baked at 120° C. for 20 minutes.

Figure 4B:
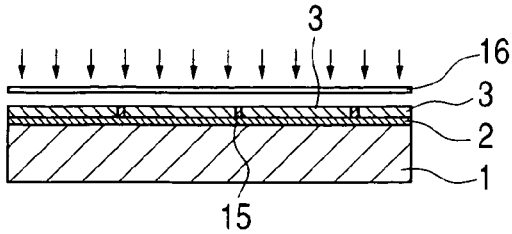

Next, as shown in FIG. 4B, first, in order to form a part of the liquid flow path constituting member (29) constituting the partition walls of the liquid flow paths (23, 24), a first coat resin layer 3 having a film thickness of 5 μm is formed on the separating layer 2 by spin coating or roll coating. Moreover, to prepare a latent image 15 for securing the curing and liquid discharge ports (22), the pattern is exposed.

As the first coat resin layer 3, the resin composition containing 100 parts of the epoxy resin (o-cresol novolak type epoxy resin), one part of the photo cation polymerization initiator (4,4-di-t-butylphenyl iodonium hexafluoroantimonate), and 10 parts of the silane coupling agent (A-187 manufactured by Nihon Yunika Co.) was dissolved in the methyl isobutyl ketone/xylene mixture liquid at a concentration of 50 wt %. The first coat resin layer 3 having a film thickness of 5 μm and having photosensitivity was formed on the separating layer 2 by spin coating. Moreover, in order to prepare the latent image 15 for securing the curing and liquid discharge ports (22), a mask 16 was used to expose the pattern by the mask aligner PLA520 (cold mirror CM290) manufactured by Canon Inc.

Figure 4C:
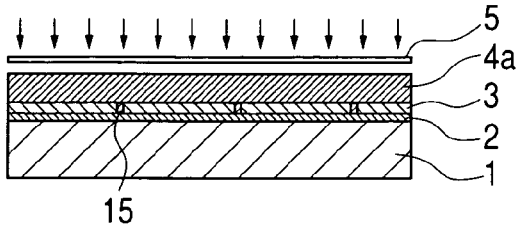

Next, as shown in FIG. 4C, in order to form the liquid pressurizing chamber (23) and liquid supply path (24), a soluble resin layer 4*a* having a film thickness of 10 μm is formed on the first coat resin layer 3. As the resin layer 4*a*, PET is coated with soluble polymethyl isopropenyl ketone (ODUR-1010 manufactured by Tokyo Ohka Kogyo Co., Ltd.) and dried to form a dry film having a film thickness of 10 μm. The film was laminated and accordingly transferred onto the first coat resin layer 3. It is to be noted that ODUR-1010 has low viscosity and cannot be formed into a thick film, and was therefore condensed and used. Next, the layer was pre-baked at 120° C. for 20 minutes.

Figure 4D:
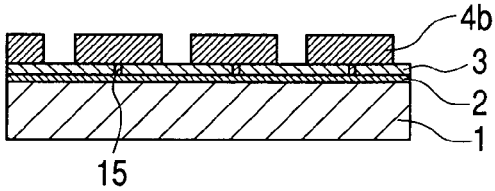

Subsequently, the mask 5 is used to expose the pattern of the liquid flow path by the mask aligner PLA520 (cold mirror CM290) manufactured by Canon Inc. The exposure was carried out for 1.5 minute, methyl isobutyl ketone/xylene=2/1 was used for the development, and xylene was used for the rinse. Accordingly, as shown in FIG. 4D, a pattern 4*b* is formed by the soluble resin, and this pattern 4*b* is formed so as to secure the liquid pressurizing chambers (23) and liquid supply paths (24).

Figure 4E:
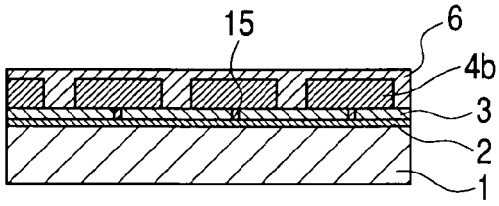

Next, as shown in FIG. 4E, in order to form a part of the vibration plate (26), partition walls (28) of the liquid flow path, or liquid flow path constituting member (29), a second coat resin layer 6 having a film thickness of 5 μm and having photosensitivity is formed on the pattern 4*b* by spin coating or roll coating. As the second coat resin layer 6, the resin composition containing 100 parts of the epoxy resin (o-cresol novolak type epoxy resin), one part of the photo cation polymerization initiator (4,4-di-t-butylphenyl iodonium hexafluoroantimonate), and 10 parts of the silane coupling agent (A-187 manufactured by Nihon Yunika Co.) is dissolved in the methyl isobutyl ketone/xylene mixture liquid at the concentration of 50 wt %. The second coat resin layer 6 having a film thickness of 5 μm and having photosensitivity was formed on the pattern 4*b* by spin coating and subsequently exposed to be cured.

Figure 4F:
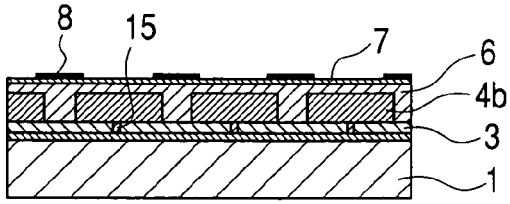
Figure 4G:
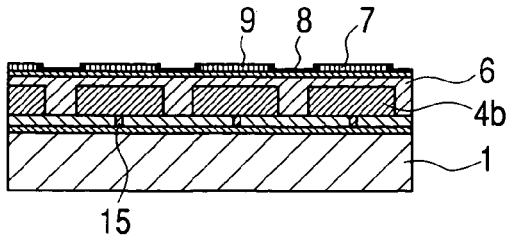
Figure 4H:
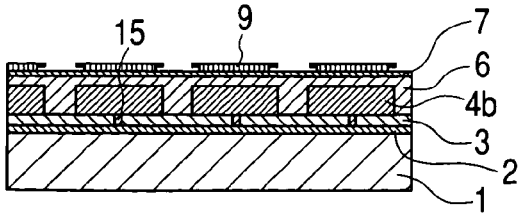

Next, as shown in FIGS. 4F to 4H, the bond portions (27) for bonding the piezoelectric elements are formed on the second coat resin layer 6. For this, first, as shown in FIG. 4F, the electrode layer 7 is formed by electroless plating. Subsequently, a non-conductive photo resist layer having a film thickness of 5 μm is applied, and a pattern 8 is formed so as to agree with a shape of a bottom of the bond portions (27). Next, this is immersed in an electrolysis liquid for electroforming containing aqueous liquid nickel ion containing 30 wt % of sulfamic acid, 0.5 wt % of nickel chloride, 4 wt % of boric acid, 1 wt % of a brightener, and 0.5 wt % of a pit preventive agent. The electrode layer 7 is used as the negative pole, and the electroforming is carried out at a current density of about 2 $mA/cm^2$. As a result, as shown in FIG. 4G, nickel in the electrolysis liquid is selectively deposited on a portion of the pattern 8 in which a photo resist layer is not formed, and the thickness of this portion increases. When the height of the pattern 8 of the photo resist layer was projected, and the pattern was developed to obtain a thickness of 18 μm, the overhang having a length of 10 μm was generated even in the surface direction of the pattern 8 of the photo resist layer by the edge effect, and electric conduction was stopped. Next, as shown in FIG. 4H, the pattern 8 of the photo resist layer was washed away to form bond portions 9 including island structures whose sections were of a rivet type.

Figure 4I:
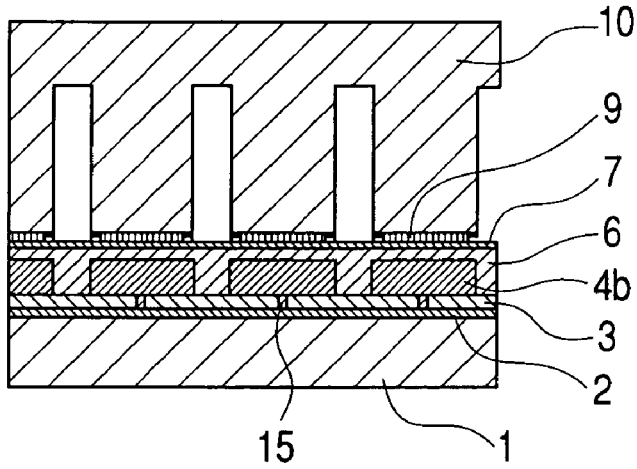

Next, as shown in FIG. 4I, an epoxy-based adhesive is used to bond a piezoelectric element 10 to the bond portions 9 including the island structures. During the bonding of the piezoelectric element 10, since the substrate 1 and/or resin layers other than the bond portions 9 has the property of optical transmission, an alignment mark (not shown) formed on the piezoelectric element 10 is observed from the substrate 1 side with a stereomicroscope, and the piezoelectric element 10 can be bonded. As the stereomicroscope, the SZH-10 (trade name) manufactured by Nikon Corp. was used. In this case, the position of the piezoelectric element 10 can accurately be determined with respect to the bond portions 9, and positional accuracy can be enhanced. After bonding the device with the epoxy-based adhesive, the device was pre-baked at 120° C. for 20 minutes.

Figure 4J:
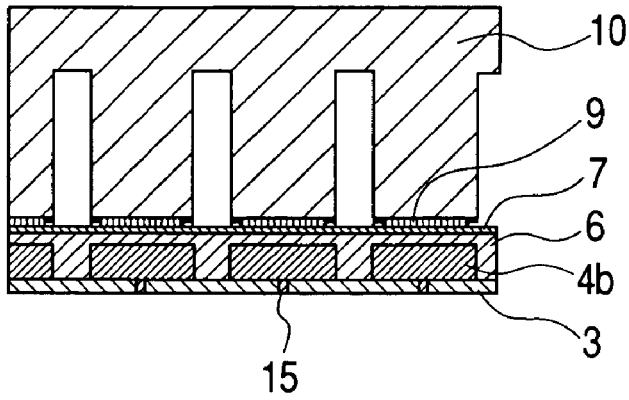

Next, as shown in FIG. 4J, an ultrasonic wave is applied into methyl isobutyl ketone while immersing the material, the separating layer 2 between the substrate 1 and first coat resin layer 3 is eluted, and the substrate 1 is separated.

Figure 4K:
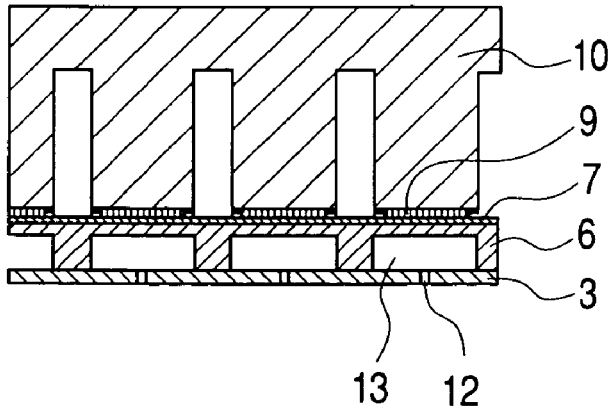

Next, as shown in FIG. 4K, the ultrasonic wave is applied into methyl isobutyl ketone while immersing the material, the latent image 15 is eluted, and the liquid discharge ports 12 (22) are formed. Thereafter, the soluble pattern resin layer 4*b* is eluted, and liquid flow paths 13 (liquid pressurizing chamber (23) or liquid supply path (24)) are formed.

Once the liquid flow paths 13 constituting the liquid pressurizing chamber (23) and liquid supply path (24) and the piezoelectric element 10 (21) have been formed in this manner, the liquid supply member (30) for supplying the liquid is bonded and the signal line and common line for driving the piezoelectric element 10 (21) which is the liquid discharge pressure generation device are electrically bonded so that the liquid jet head is completed.

In the same manner as in the first embodiment, the liquid jet head prepared in this manner was mounted on a liquid jet apparatus to perform printing/recording. Then, stable printing was possible, and the obtained printed matter was of a high grade.

The liquid jet head of the present invention prepared as described above is effective as a liquid jet head of a full line type which can simultaneously carry out recording over the whole width of a recording sheet. Furthermore, the present invention is also effective for a color recording head in which the liquid jet head is integrally formed or a plurality of heads are combined. Moreover, the present invention can also be applied to solid ink which liquefies upon reaching or exceeding a certain temperature.

What is claimed is:

1. A method of manufacturing a liquid jet head having a liquid discharge port for discharging liquid, a liquid flow path communicating with the liquid discharge port and a liquid discharge energy generation element provided in a place corresponding to the liquid flow path to generate energy used for discharging the liquid, said method comprising:

a step of forming on a substrate a first coat resin layer on which the liquid discharge port is provided;

a step of forming a liquid flow path pattern with a soluble resin in the first coat resin layer;

a step of forming a second coat resin layer which constitutes a liquid flow path wall and a vibration plate, the liquid flow path wall being a wall covering the liquid flow path pattern;

a step of disposing the liquid discharge energy generation element in a place corresponding to the liquid flow path;

a step of forming a bond layer constituting a bond portion with respect to the liquid discharge energy generation element on the second coat resin layer;

a step of separating and removing the substrate; and a step of removing the liquid flow path pattern to form the liquid flow path.

2. The method of manufacturing the liquid jet head according to claim 1, further comprising a step of forming a liquid discharge port in the first coat resin layer, between the step of separating and removing the substrate and the step of forming the liquid flow path.

3. The method of manufacturing the liquid jet head according to claim 1, further comprising a step of forming a liquid discharge port in the first coat resin layer, between the step of forming the first coat resin layer and the step of forming the liquid flow path pattern.

4. The method of manufacturing the liquid jet head according to claim 3, further comprising the step of forming the second coat resin layer on the substrate by spin coating or roll coating.

5. The method of manufacturing the liquid jet head according to claim 1, wherein the step of separating and removing the substrate comprises eluting a separating layer of a soluble resin formed on the substrate.

6. The method of manufacturing the liquid jet head according to claim 1, wherein the second coat resin layer contains a solid epoxy resin at room temperature.

7. The method of manufacturing the liquid jet head according to claim 1, wherein the first coat resin layer, the second coat resin layer, and the liquid flow path pattern are optically transmissive.

8. The method of manufacturing the liquid jet head according to claim 1, wherein the liquid discharge energy generation element is a piezoelectric element.

* * * * *

UNITED STATES PATENT AND TRADEMARK OFFICE

CERTIFICATE OF CORRECTION

PATENT NO. : 7,014,987 B2
APPLICATION NO. : 10/619004
DATED : March 21, 2006
INVENTOR(S) : Hidehito Takayama et al.

It is certified that error appears in the above-identified patent and that said Letters Patent is hereby corrected as shown below:

ON THE TITLE PAGE

At Item (74), *Attorney, Agent or Firm*, "Fitzpatrick Cella Harper & Scinto" should read --Fitzpatrick, Cella, Harper & Scinto--.

COLUMN 5

Line 26, "forrinsing" should read --for rinsing--.

COLUMN 9

Line 43, "layer on" should read --layer in--.

Signed and Sealed this

Seventeenth Day of October, 2006

JON W. DUDAS
*Director of the United States Patent and Trademark Office*